US008281416B1

(12) United States Patent
Smith

(10) Patent No.: US 8,281,416 B1
(45) Date of Patent: Oct. 9, 2012

(54) COOKING UTENSIL GRIPPING GLOVE

(76) Inventor: Nicole H. Smith, Danville, VA (US)

( * ) Notice: Subject to any disclaimer, the term of this patent is extended or adjusted under 35 U.S.C. 154(b) by 279 days.

(21) Appl. No.: 12/775,860

(22) Filed: May 7, 2010

(51) Int. Cl.
*A41D 19/00* (2006.01)

(52) U.S. Cl. ..... 2/161.6; 2/161.8

(58) Field of Classification Search ..... 2/158, 159, 2/161.6, 161.8, 161.1–161.4, 163, 160, 162, 2/16, 17, 20
See application file for complete search history.

(56) References Cited

U.S. PATENT DOCUMENTS

| | | | | | |
|---|---|---|---|---|---|
| 2,294,997 | A | * | 9/1942 | Merrion | 2/160 |
| 2,877,465 | A | * | 3/1959 | Stroud | 2/20 |
| 3,105,972 | A | * | 10/1963 | Christopher | 2/161.2 |
| 3,232,632 | A | * | 2/1966 | Lewis | 280/822 |
| 3,348,238 | A | * | 10/1967 | Hydock | 2/161.2 |
| 3,532,344 | A | * | 10/1970 | Masstab | 473/205 |
| 3,559,212 | A | * | 2/1971 | Skovron | 2/161.4 |
| 4,203,495 | A | | 5/1980 | Crownover | |
| 4,691,387 | A | * | 9/1987 | Lopez | 2/161.3 |
| 4,698,851 | A | * | 10/1987 | Dunford et al. | 2/160 |
| 4,793,005 | A | * | 12/1988 | Hetzel, Jr. | 2/161.1 |
| 5,004,231 | A | * | 4/1991 | Alread | 482/139 |
| 5,018,221 | A | * | 5/1991 | Romandetto | 2/16 |
| 5,022,094 | A | * | 6/1991 | Hames et al. | 2/163 |
| 5,033,119 | A | * | 7/1991 | Wiggins | 2/162 |
| 5,511,248 | A | | 4/1996 | Widdemer | |
| 5,634,213 | A | * | 6/1997 | Grover | 2/161.1 |
| 5,878,438 | A | * | 3/1999 | Ragsdale | 2/158 |
| 5,878,439 | A | * | 3/1999 | Waters, Jr. | 2/161.6 |
| 6,006,358 | A | * | 12/1999 | Keating | 2/161.1 |
| 6,374,417 | B1 | | 4/2002 | Stagnitta | |
| 6,397,394 | B1 | | 6/2002 | Hambly | |
| 6,550,068 | B1 | | 4/2003 | Materon | |
| 6,564,389 | B1 | * | 5/2003 | Laughlin | 2/158 |
| 6,898,804 | B2 | | 5/2005 | Sandler | |
| 7,383,590 | B1 | * | 6/2008 | Duncan | 2/158 |
| 2002/0010957 | A1 | | 1/2002 | Katz | |
| 2003/0079273 | A1 | * | 5/2003 | Genkins | 2/161.6 |
| 2005/0268372 | A1 | * | 12/2005 | DeMarco | 2/160 |
| 2005/0278827 | A1 | * | 12/2005 | Price et al. | 2/158 |
| 2006/0015983 | A1 | * | 1/2006 | Kim et al. | 2/161.2 |
| 2009/0100562 | A1 | * | 4/2009 | Liang | 2/20 |
| 2009/0222972 | A1 | * | 9/2009 | Joung | 2/161.3 |

* cited by examiner

*Primary Examiner* — Amy Vanatta
(74) *Attorney, Agent, or Firm* — Montgomery Patent & Design LLC; Robert C. Montgomery; Joseph Yaksich

(57) ABSTRACT

A device used while cooking to retain utensils and protect a user's hand and forearm from grease splatters is herein described. The device comprises a glove body made of a flexible fire-resistant material with individual finger and thumb appendages for increased dexterity. The device extends from the hand portion toward a wearer's elbow where an elastic strap provides a seal which prevents heated grease from splattering inside of the glove. A pair of straps is located within the palm area to help retain spatulas, spoons, tongs, whisks, or other similar food preparation utensils. The straps are secured together with fasteners thereby allowing the straps to adjust to any size utensil handle.

14 Claims, 2 Drawing Sheets

COOKING UTENSIL GRIPPING GLOVE

RELATED APPLICATIONS

The present invention was first described in a notarized Official Record of Invention on Jun. 5, 2009, that is on file at the offices of Montgomery Patent and Design, LLC, the entire disclosures of which are incorporated herein by reference.

FIELD OF THE INVENTION

The present invention relates generally to cooking utensils, and in particular, to a glove adapted for the secure and safe handling of common cooking utensils.

BACKGROUND OF THE INVENTION

Many culinary processes involve the heating or cooking of foodstuffs during preparation. Cooking processes such as frying, grilling, and the like are integral to the correct preparation of many dishes. Due to the temperatures involved in such processes, many different utensils including tongs, spatulas, and spoons are used to avoid direct contact between the user's skin and the high temperature foods and cooking surfaces.

One (1) problem often encountered while cooking such dishes is that of incidental contact with high temperature substances. Many processes involve large amounts of heated liquids such as grease to facilitate cooking. Painful injuries are often sustained when these liquids splatter, bubble, or splash, thereby burning the user.

Various attempts have been made to provide means for handling cooking utensils and other items. Examples of these attempts can be seen by reference to several U.S. patents. U.S. Pat. No. 4,203,495, issued in the name of Crownover, describes a glove device with integral tool elements which are attached to the glove with a bar grip.

U.S. Pat. No. 6,374,417, issued in the name of Stagnitta, describes a food handling glove. The Stagnitta device provides a glove which may be utilized to directly grip foodstuffs during preparation, providing features of enhanced traction and thermal insulation.

While these devices fulfill their respective, particular objectives, each of these references suffer from one (1) or more of the aforementioned disadvantages. Many such devices are not usable with a wide range of existing utensils. Also, many such devices do not adequately protect a user from grease splatters and the like. Accordingly, there exists a need for a cooking utensil gripping glove without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a cooking utensil gripping glove which allows a user to securely and safely utilize existing cooking utensils during grilling, frying, and the like.

Thus, the object of the present invention is to solve the aforementioned disadvantages and provide for this need.

To achieve the above objectives, it is an object of the present invention to comprise a cooking utensil gripping glove which provides a means for protecting a user from injuries inflicted by splashes from heated cooking oil or frying grease.

Another object of the present invention is to stabilize handle portion of an existing utensil. The invention comprises a pair of straps which encircle the handle portion of the utensil. The straps are integrally attached to the glove on one (1) end and are removably fastenable to each other via a conventional adjustable fastening means.

Yet still another object of the present invention is to provide versatile use with differing sizes of utensil handles via the adjustable fastening means.

Yet still another object of the present invention is to allow use and easily manipulation of a wide variety of existing tools by comprising the shape of a conventional glove with individual finger portions.

Yet still another object of the present invention is to facilitate the picking up and retention of the handle portion of an existing utensil. A palm side of each fingertip of the glove comprises a gripping pad which provides enhanced traction to a user.

Yet still another object of the present invention is to prevent the intrusion of splashed heated oil or grease by providing a seal around a user's forearm. The seam comprises an elastic closure at a bottom end portion of the device.

Yet still another object of the present invention is to comprise a fire-resistant material in order to provide enhanced safety to a user in the vicinity of high temperature surfaces.

Yet still another object of the present invention is to provide a method of utilizing the device that provides a unique means of donning the glove, securely engaging an existing tool via the fastening means, providing a secure grip via the gripping pads, and preventing injuries from splattered grease and the like via the elastic closure and fire resistant covering of the hand and lower arm.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

| DESCRIPTIVE KEY | |
|---|---|
| 10 | cooking utensil gripping glove |
| 11 | glove |
| 12 | elastic closure |
| 13 | gripping pad |
| 14 | first strap |
| 15 | second strap |
| 20 | alternate cooking utensil gripping glove |
| 21 | alternate glove |
| 24 | third strap |
| 25 | fourth strap |

-continued

| DESCRIPTIVE KEY | |
|---|---|
| 30 | palm gripping pad |
| 50 | utensil |
| 60 | user forearm |

DETAILED DESCRIPTION OF THE PREFERRED EMBODIMENT

Figure 1:
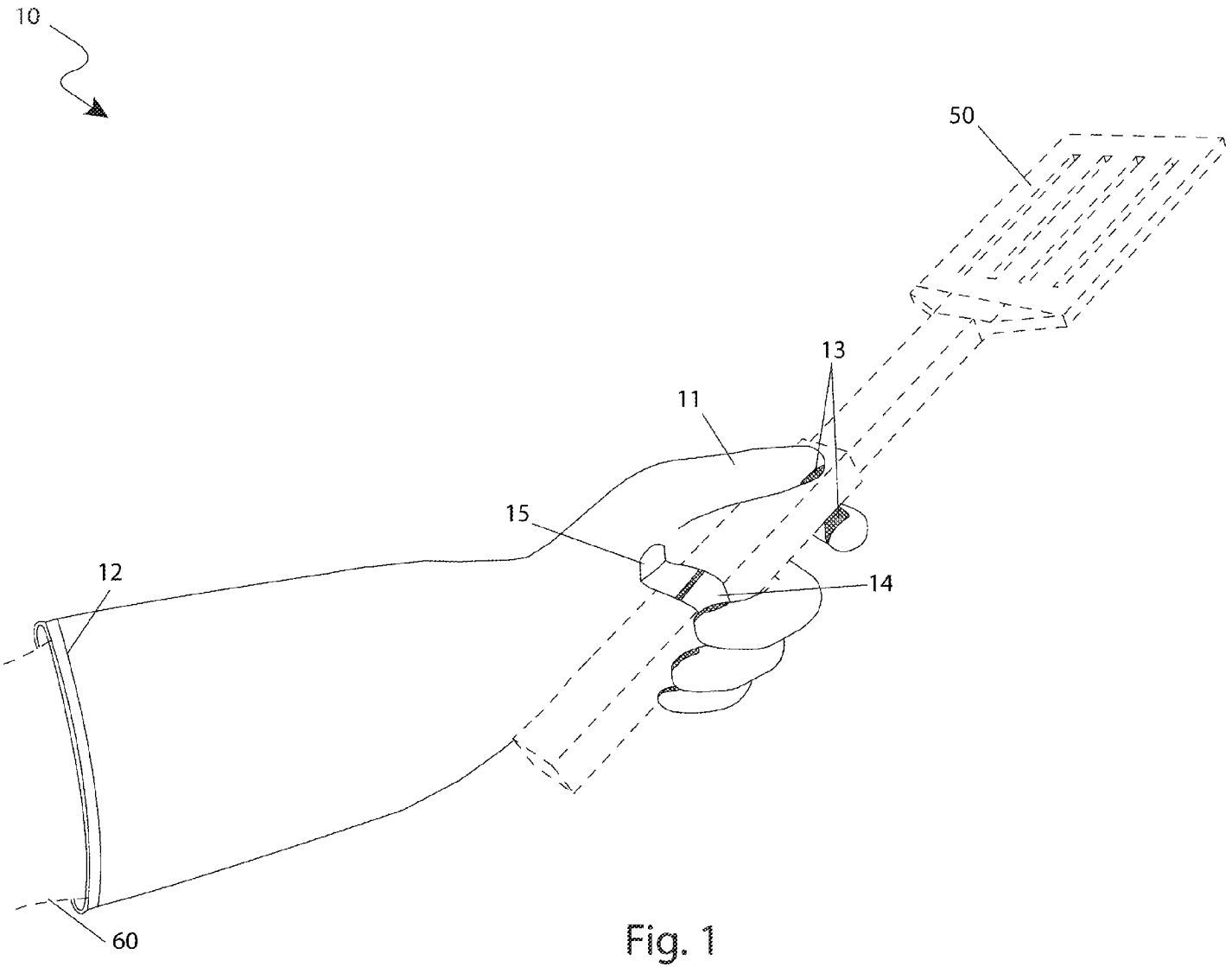
FIG. 1 is an environmental view of a cooking utensil gripping glove 10, according to a preferred embodiment of the present invention.
Figure 2A:
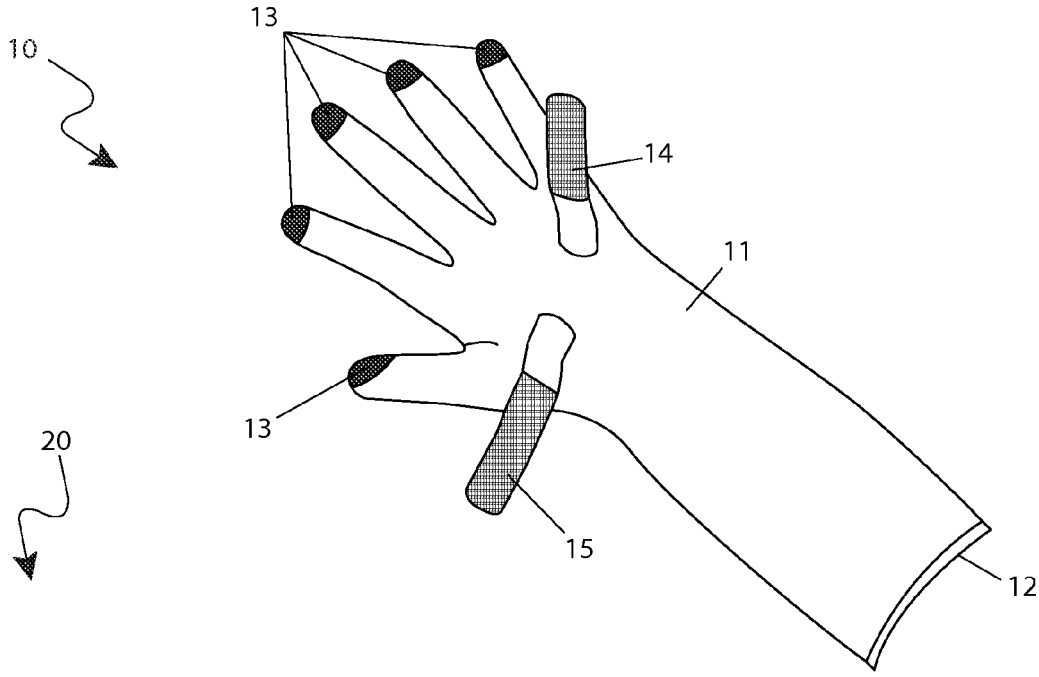
FIG. 2A is a palm-side view of a cooking utensil gripping glove 10, according to the preferred embodiment 10 of the present invention; and, FIG. 2B is a palm-side view of a cooking utensil gripping glove 20, according to an alternate embodiment of the present invention.
Figure 2B:
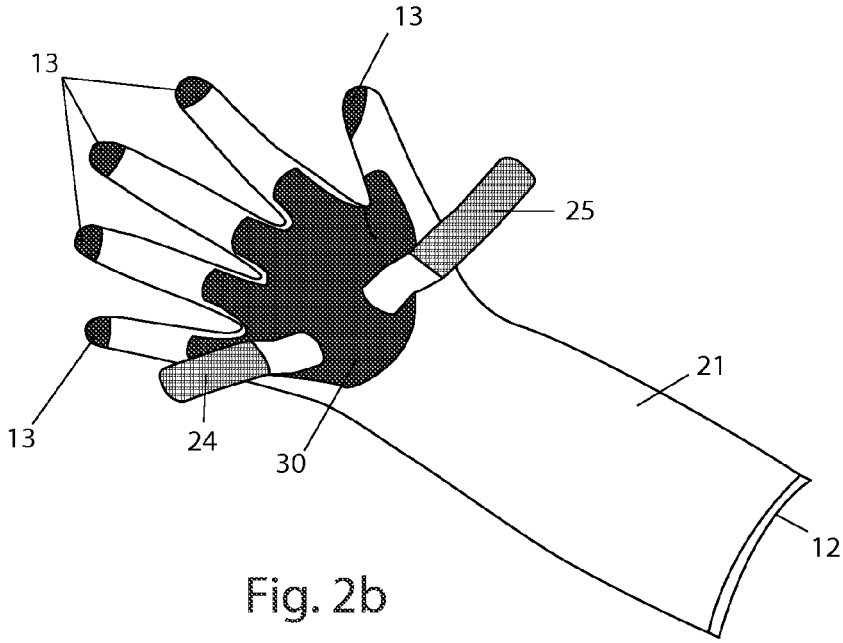

The best mode for carrying out the invention is presented in terms of its preferred embodiment, herein depicted within FIGS. 1 and 2A, and alternately within FIG. 2B. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a cooking utensil gripping glove (herein described as the "device") 10, which provides a means for protecting a user from injuries inflicted by splashes from heated cooking oil or frying grease.

Referring now to FIG. 1, an environmental view of the device 10, according to the preferred embodiment of the present invention, is disclosed. The device 10 is depicted in as state of being worn on the forearm 60 of a user while gripping a utensil 50 within the glove 11. The handle portion of the utensil 50 is stabilized by the encircling action of a first strap 14 being closed onto a second strap 15 by means of a hook-and-loop-type fastening means. It is envisioned that the device 10 is designed to be worn on a right hand, whereas a left-handed user would wear an alternate utensil gripping glove 20 in a similar manner on a left hand. It is further envisioned that a user could wear both the device 10 and the alternate device 20 simultaneously whenever additional protection for both the right and the left hand and forearm 60 is desired.

Referring now to FIG. 2A, a palm-side view of the device 10, according to the preferred embodiment of the present invention, is disclosed. The device 10 comprises a glove 11 wherein the palm-side of each fingertip comprises a gripping pad 13 intended to facilitate picking up and retaining the handle portion of the utensil 50 or other cooking implements. The bottom end portion of the device 10 comprises an elastic closure 12 designed to prevent the intrusion of splashed heated oil or grease by providing a seal around a user's forearm. The glove 11 further comprises a first strap 14 and a second strap 15 intended to stabilize the utensil within the palm of the glove 11. The glove 11 is envisioned to be made of a fire-resistant material, such as: modecrylic fiber (PROTEX®), aramid fiber (NOMEX®, KEVLAR®), or mineral fiber (KAOWOOL®), wherein appropriate fabric shapes are cutout and sewn, stitched, bonded, or laser welded together, or said materials in fiber form are knitted into the configuration of the glove 11. The straps 14 and 15 are envisioned to be made of similar fire-resistant material as the glove 11 and to be provided with a hook-and-loop-type closure means. This type of closure is preferred in order to provide greater versatility depending on differing sizes handles of utensils 50. The gripping pads 13 are made of the similar fire-resistant materials, whereby their gripping face portion is provided with a rough no-slip texture. The plurality of the pads 13 along with the straps 14 and 15 are envisioned to be bonded, sewn, or stitched onto the palm-side of each fingertip and within the palm of the glove 11.

Referring now to FIG. 2B, a palm-side view of the device 20, according to the alternate embodiment of the present invention, is disclosed. The alternate device 20 comprises an alternate glove 21 wherein the palm-side of each fingertip comprises the gripping pad 13 as well as a palm gripping pad 30 in a configuration generally similar to the glove 11. The bottom end portion of the alternate glove 21 also comprises the elastic closure 12 and the palm portion of the glove 21 comprises a third strap 24 and a fourth strap 25. The glove 21 and the straps 24 and 25 are made of the similar fire-resistant material and are manufactured by similar processes as the device 10.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be worn as indicated in FIG. 1.

The method of utilizing the device 10 may be achieved by performing the following steps: removing the device 10 from a storage drawer; grasping the elastic closure 12 between the thumb and index finger of the left hand; moving the fingers of the right hand into a close proximity with each other; inserting the fingers into the elastic closure 12; using the left hand thumb and index finger to pull the device 10 over the user's forearm; pulling the glove 11 toward the user's elbow until the entire length of the forearm 60 is enclosed and each of the user's fingers abut the inside finger tip portion of the glove 11; placing the handle of the utensil 50 hereinto the palm of the glove 11 and under the first strap 14, whereby the bottom end portion of the handle of the utensil 50 rests against the base of the thumb; holding the handle of the utensil 50 between the thumb and index finger of the gloved right hand; using the thumb and index finger of the left hand to stabilize the handle portion of the utensil 50 by closing the first strap 14 tightly onto the second strap 15; proceeding with the desired cooking processes; grasping and pulling one of the fingers of the glove 11 between the thumb and index finger of the left hand to initiate the removal of the glove 11; totally removing the glove 11 by using the thumb and index finger of the left hand to sequentially pull the fingers of the glove 11; and, washing, laundering or cleaning and storing the glove 11.

The method of utilizing the alternate device 20 may be achieved by performing steps similar to those described in the foregoing but with the assistance of the right hand instead of the left hand.

The method of simultaneously utilizing the preferred device 10 and the alternate device 20 may be achieved by performing similar steps as those described in the foregoing, except that the assistance of the hand wearing the device 10 or of a helper will be needed to install the device 20.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A gripping tool worn by a user, further comprising:

a glove body, having a hand member, a plurality of finger members outwardly extending from a first end of said hand member, and an elongate sleeve member outwardly extending from a second end of said hand member;

a first strap, having a first end extending outward from a palm side of said hand member;

a first fastener, located on a second end of said first strap;

a second strap, having a first end extending outward from said palm side of said hand member opposite of said first strap; and, a second fastener, located on a second end of said second strap;

wherein said first strap and said second strap enclose around a handle of a utensil to securely attach said tool to said utensil; and, wherein said first fastener correspondingly mates with said second fastener; and, a gripping means on a palm side of said plurality of finger members;

wherein said gripping means facilitate picking up and retaining said utensil; and, wherein said gripping tool is provided in either a left-hand or a right-hand configuration.

2. The gripping tool of claim 1, wherein said elongate sleeve member extends to at least a forearm of said user.

3. The gripping tool of claim 2, further comprising an elastic closure for sealing entry of fluids or debris from entering said elongate sleeve member.

4. The gripping tool of claim 1, wherein said gripping means further comprises a non-slip gripping pad bonded to a palm side of said fingertip portion of each of said plurality of finger members.

5. The gripping tool of claim 1, wherein said glove body further comprises a fire-resistant material.

6. The gripping tool of claim 5, wherein said fire-resistant material is one of the following list: modecrylic fiber, aramid fiber, or mineral fiber.

7. The gripping tool of claim 1, wherein said first fastener and said second fastener are a hook-and-loop-type fastener.

8. A gripping tool worn by a user, further comprising:

a glove body, having a hand member, a plurality of finger members outwardly extending from a first end of said hand member, and an elongate sleeve member outwardly extending from a second end of said hand member;

a first strap, having a first end extending outward from a palm side of said hand member;

a first fastener, located on a second end of said first strap;

a second strap, having a first end extending outward from said palm side of said hand member opposite of said first strap; and, a second fastener, located on a second end of said second strap;

wherein said first strap and said second strap enclose around a handle of a utensil to securely attach said tool to said utensil; and, wherein said first fastener correspondingly mates with said second fastener; and, a gripping means on a palm side of said plurality of finger members and said hand member;

wherein said gripping means facilitate picking up and retaining said utensil; and, wherein said gripping tool is provided in either a left-hand or a right-hand configuration.

9. The gripping tool of claim 8, wherein said elongate sleeve member extends to at least a forearm of said user.

10. The gripping tool of claim 9, further comprising an elastic closure for sealing entry of fluids or debris from entering said elongate sleeve member.

11. The gripping tool of claim 8, wherein said gripping means further comprises a non-slip gripping pad bonded to a palm side of said fingertip portion of each of said plurality of finger members and a palm side of said hand member.

12. The gripping tool of claim 8, wherein said glove body further comprises a fire-resistant material.

13. The gripping tool of claim 12, wherein said fire-resistant material is one of the following list: modecrylic fiber, aramid fiber, or mineral fiber.

14. The gripping tool of claim 8, wherein said first fastener and said second fastener are a hook-and-loop-type fastener.

* * * * *